US007789809B2

(12) United States Patent
Borth et al.

(10) Patent No.: US 7,789,809 B2
(45) Date of Patent: Sep. 7, 2010

(54) JUMP ROPE SYSTEM

(76) Inventors: Paul E. Borth, 628 W. Oak St., Lafayette, CO (US) 80026; Mary L. Metz, 628 W. Oak St., Lafayette, CO (US) 80026

( * ) Notice: Subject to any disclaimer, the term of this patent is extended or adjusted under 35 U.S.C. 154(b) by 0 days.

(21) Appl. No.: 12/080,272

(22) Filed: Apr. 1, 2008

(65) Prior Publication Data

US 2009/0247373 A1 Oct. 1, 2009

(51) Int. Cl.
*A63B 5/20* (2006.01)

(52) U.S. Cl. ..... 482/82

(58) Field of Classification Search ..... 482/81–82, 482/121, 126, 109–110; 119/712, 769, 795; 463/47.2, 47.5; 403/76; 16/110.1, 417–418, 16/422, 428, 430; 74/543, 548; *A63B 5/20*
See application file for complete search history.

(56) References Cited

U.S. PATENT DOCUMENTS 2,719,038 A * 9/1955 Massa ..... 482/82
4,101,123 A 7/1978 Anthony
4,330,118 A 5/1982 Race
4,801,137 A 1/1989 Douglass
5,054,772 A 10/1991 Winston
5,478,297 A * 12/1995 Dennis, Jr. ..... 482/82
6,551,222 B1 4/2003 Beaver
6,736,763 B1 * 5/2004 Hsu ..... 482/82
6,752,746 B1 * 6/2004 Winkler et al. ..... 482/82

OTHER PUBLICATIONS

The Merriam-Webster Dictionary, http://www.merriam-webster.com/dictionary/blade, May 12, 2010, 2 pages.*

* cited by examiner

*Primary Examiner*—Loan Thanh
*Assistant Examiner*—Oren Ginsberg
(74) *Attorney, Agent, or Firm*—Craig R. Miles; CR Miles, P.C.

(57) ABSTRACT

A jump rope which provides a pair of handles each handle providing a shaft coaxially rotatably engaged to a first bearing element and a second bearing element which attaches to a corresponding one of the opposed ends of a cable means.

10 Claims, 6 Drawing Sheets

JUMP ROPE SYSTEM

I. BACKGROUND

A jump rope which provides a pair of handles each handle providing a shaft coaxially rotatably engaged to a first bearing element and a second bearing element which attaches to a corresponding one of the opposed ends of a cable element.

Rope jumping also referred to as rope skipping, skip roping, and jump rope is a skilled activity. There are literally thousands of jump rope skills which rope jumpers strive to achieve at increasingly greater jump rope spin or turn rates. While conventional jump ropes have improved over time, substantial problems with conventional jump ropes still remain unresolved.

A first substantial problem with convention jump ropes may be that the constructional form of the jump rope handles limits the rate at which the attached rope or cable element of the jump rope can be spun or turned. One aspect of this problem may be the level of resistance to rotation of the rope or cable element by conventional jump rope handles. The greater the level of resistance to rotation of the cable within the jump rope handle the lower the rate of turn or spin achievable by a jumper. A second aspect of this problem may be that the rope or cable element attaches too closely or too far from the jump rope handle. Attachment of the rope or cable element too close to the handle may result in contact between the cable element and the handle during turns of the rope or cable element. Attachment of the rope or cable element to far from the jump rope handle establishes the length of the lever arm through which the forces developed as the jump rope spins or turns are directed to the jump rope handles. As the lever arm increases in length, the difficulty in controlling the motion correspondingly generated in the handles can increase to an extent that the rate at which the rope or cable element turns can not be increased. A third aspect of this problem can be that attachment of the cable to the handle does not allow the cable to swivel on the cable axis or allow the cable to pivot relative to the handle. Accordingly, even a small amount of movement in the handle by the jumper can alter the configuration of the rope or cable element as it turns. Alteration in the configuration of the rope or cable element can limit the rate at which the rope or cable element can be turned or make controlling the turn or spin more difficult.

The instant invention addresses each of these problems with conventional jump ropes.

II. SUMMARY OF THE INVENTION

Accordingly, a broad object of the invention can be to provide a pair of handles each handle providing a shaft coaxially rotatably engaged to a first bearing element and a second bearing element each shaft correspondingly attached to one of the opposed ends of a cable element.

A second broad object of the invention can be to provide a handle which provides a handle which coaxially retains a first bearing element and a second bearing element which rotatably engage a shaft which provides a first shaft end configured to attach to one of a pair of opposed ends of a cable element.

A third broad object of the invention can be to provide a first shaft end configured to provide a cable pivot element which provides a swivel range and a pivot range through which the handle can travel in relation to the cable element or which the cable element can travel in relation to the handle.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A jump rope which provides a pair of handles each handle providing a shaft coaxially rotatably engaged to a first bearing element and a second bearing element which attaches to a corresponding one of the opposed ends of a cable element.

Figure 1:
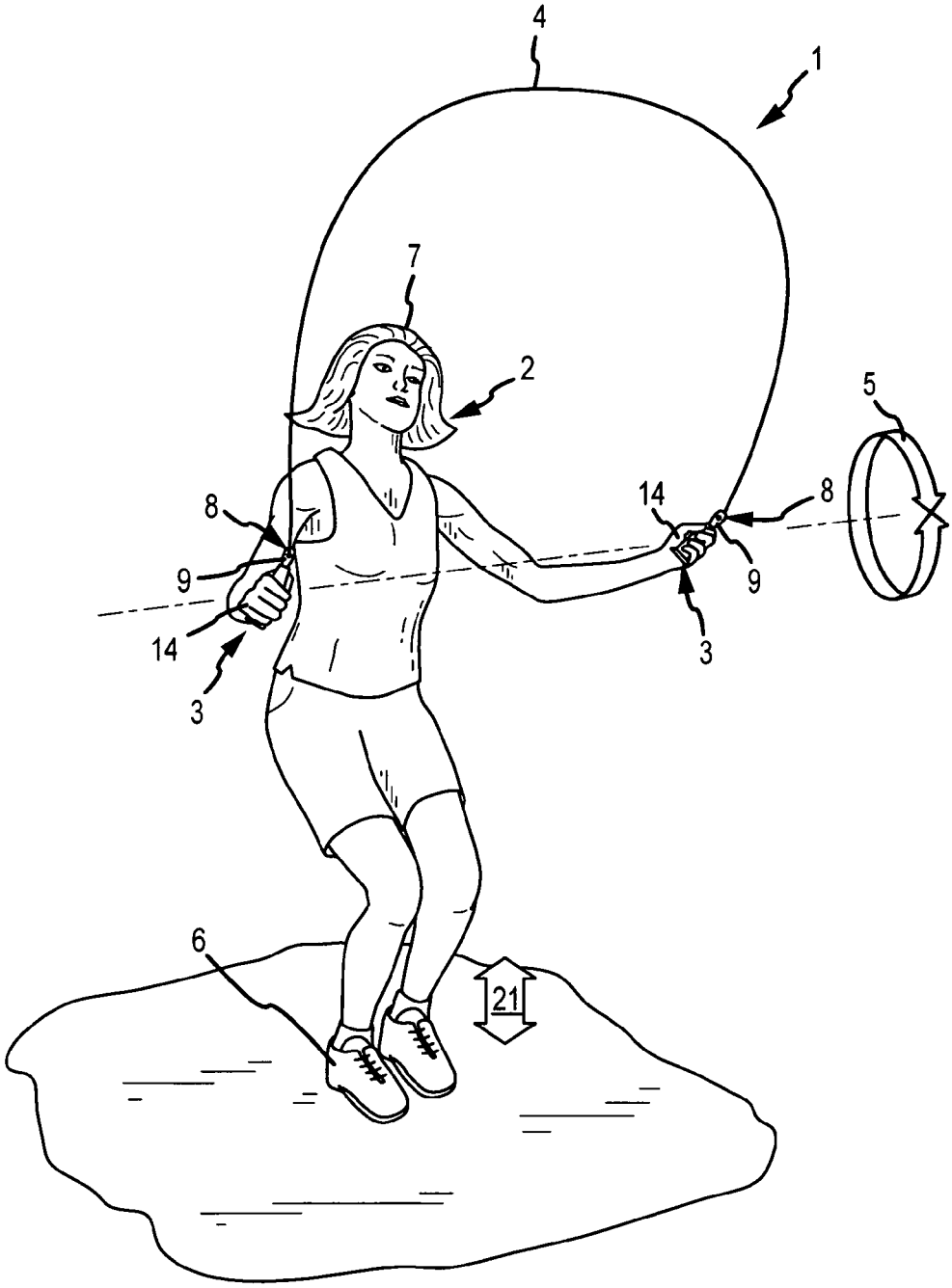
FIG. 1 depicts a particular method of using an embodiment of the inventive jump rope.

Now referring primarily to FIG. 1, which depicts a particular non-limiting method of using the inventive jump rope (1), a jumper (2) by gripping each of a pair of handles (3) can cause a cable element (4) attached to each of the pair of handles (3) to turn (5). Jumping over the turned cable element (4) so that the cable element (4) passes under the feet (6) and over the head (7) allows the jumper (2) to perform a basic jump (21). By attaching each one of a pair of opposed cable ends (8) of the cable element (4) to a shaft (9) (see also FIGS. 5-7) coaxially rotatably engaged to a first bearing element (10) and a second bearing element (11) retained in each one of the pair of handles (3), the cable element (4) can turn (5) in lesser amount time per turn or can turn (5) at an increased number of turns per unit time or turned (5) at the same number of turns per unit time with less effort.

While the embodiment of the method of using the inventive jump rope system (1), shown by FIG. 1 includes a single jumper (2) who also turns the cable element (4), the method is not so limited, and as a further non-limiting example, the jumper (2) can be assisted by a pair of cable turners (not shown) each of which by gripping one of the pair of handles (3) can cause the cable element (4) to turn (5) while the jumper (2) jumps. As to other embodiments of the inventive jump rope (1) the pair of cable turners can turn a pair of the inventive jump ropes (1). Moreover, the jumper (2) can be joined by additional jumpers such that a plurality of jumpers can jump using one or more of the inventive jump ropes (1).

Figures 2, 3, 4:
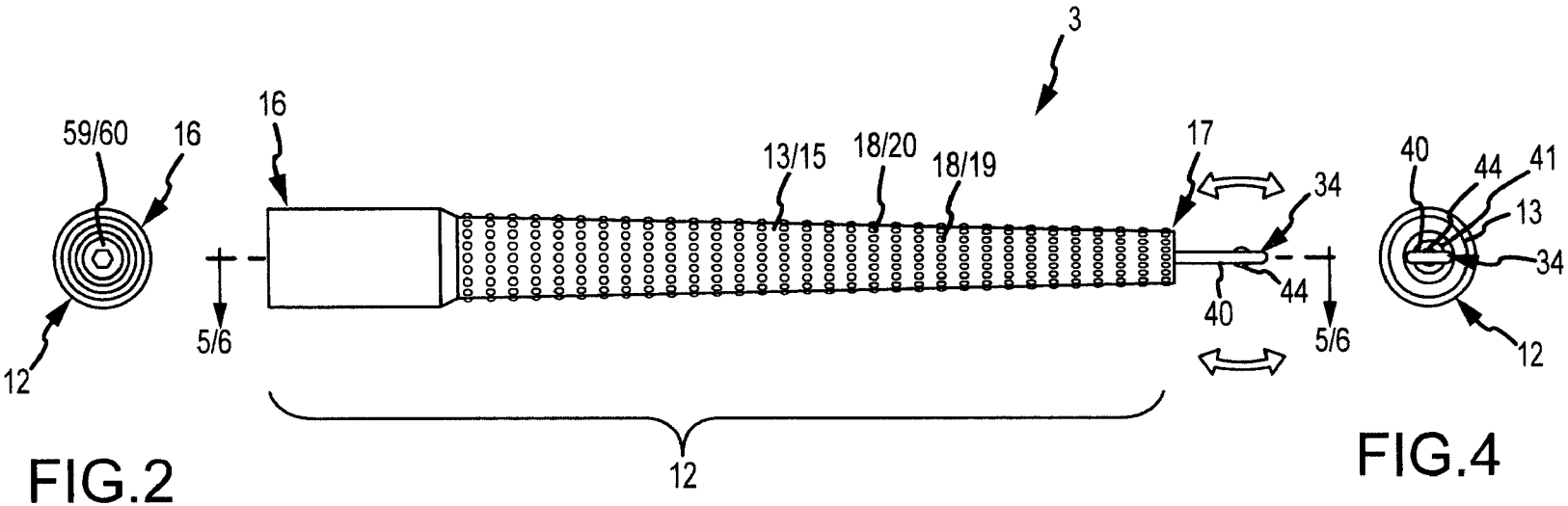
FIG. 2 is a second handle end view of one of a pair of handles of a particular embodiment of the inventive jump rope.
FIG. 3 is a side view of one of a pair of handles of a particular embodiment of the inventive jump rope.
FIG. 4 is a first handle end view of one of a pair of handles of a particular embodiment of the inventive jump rope.

Now referring primarily to FIGS. 2-4, the inventive jump rope (1) can provide a handle means (12). The handle means (12) can have an external handle surface (13) configured to be gripped by a hand (14) of the jumper (2) (see FIG. 1). The non-limiting embodiment of the external handle surface (13) shown in FIG. 3 provides a grippable frustoconical member (15) which tapers between a first handle end (16) of larger diameter and a second handle end (17) of lesser diameter. The first handle end (16) can provide a larger diameter of between about one half inch and about one inch and the second handle end (17) can provide a smaller diameter of between about three eighths inch and three quarters inch. The handle means (12) will typically have length between the first handle end (16) and the second handle end (17) of between about four inches and about six inches; although certain embodiments the handle means can be of greater or lesser length. While the example of the handle means (12) shown in FIGS. 2-4 can be utilized with various embodiments of the inventive jump rope (1), the invention is not so limited, and the handle means (12) can provide any of a numerous and wide variety of external handle surface (13) configurations including without limitation cylindrical members, square members, triangular members, spherical members, conical members, or other configurations grippable by the hand (14) of the jumper (2).

The external handle surface (13) can further provide any one or more of a plurality of texture elements (18). The texture elements (18) typically provide a plurality of relief elements (19) or a plurality of recessed elements (20) in relation to the external handle surface (12) which can function to increase grippable engagement with the external handle surface (12) by the hand (14) of the jumper (2). As a non-limiting example, a suitable configuration for the texture elements (18) can be MT-11030.

Embodiments of the handle means (12) can be generated by fabrication or by molding from a wide variety of materials such as plastics such as styrene, nylon, vinyl, sulfone polymers, or the like; or metals such as iron, aluminum, stainless steel, or the like; or fiberglass; or wood, or combinations and permutations thereof, and as but one particular example, the handle means (12) can be injection molded from a nylon such as DUPONT® Nylon. Typically, the material and the configuration of the handle means (12) are selected to provide a substantially rigid configuration of the handle means (12) to maintain the first bearing element (10) and the second bearing element (1) in coaxial relation to allow coaxial rotatable engagement of the shaft (9) in the bearing elements (10)(11); however, this is not intended to preclude configurations of the handle means (12) which can provide an amount of flexure and while maintaining the coaxial relation of the bearing elements (10)(11).

Now referring primarily to FIGS. 5-9, regardless of the configuration, the handle means (12) can be further adapted to retain a first bearing element (10) and a second bearing element (11) disposed in coaxial relation a distance apart with a shaft (9) coaxially rotatably engaged to the first bearing element (10) and the second bearing element (11). The term "bearing element" for the purposes of this invention means an annular member whether formed as a discrete part(s) or as one piece with handle means (12) which provides a cylindrical bearing surface (22).

Figure 7:
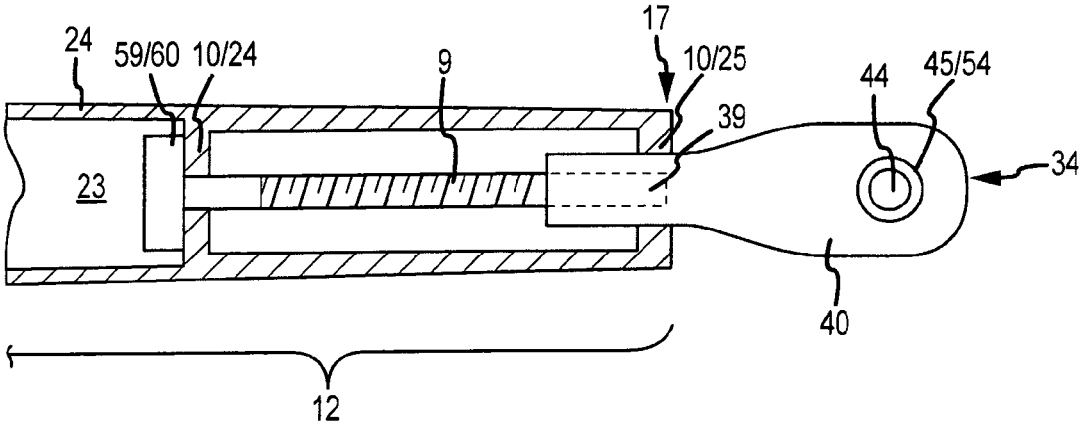
FIG. 7 is a cross section of the second handle end of a particular embodiment of the inventive jump rope.

Now referring to the non-limiting example of FIG. 7, the handle means (12) can provide a hollow inside space (23) defined by an internal surface of the handle wall (24) which can further provide the first bearing element (10) and the second bearing element (11) each in the form of an annular member (24)(25) formed as a part of the handle means (12) disposed in coaxial relation a distance apart each providing the cylindrical bearing surface (22).

Figure 8:
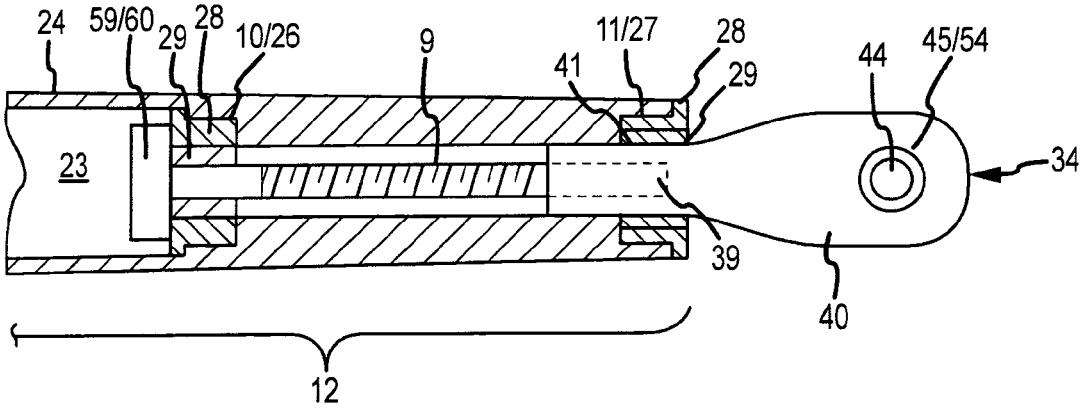
FIG. 8 is a cross section of the second handle end of a particular embodiment of the inventive jump rope.

Referring now to FIG. 8, which provides a second example of a first bearing element (10) and a second bearing element (11) each in the form of a rotatable bearing element (26)(27) which provides a first circular bearing member (28) coaxially slidly engaged to a second circular bearing member (29) which carries a load by the relative motion of the second circular bearing member (29) on the first circular bearing member (28).

Figure 9:
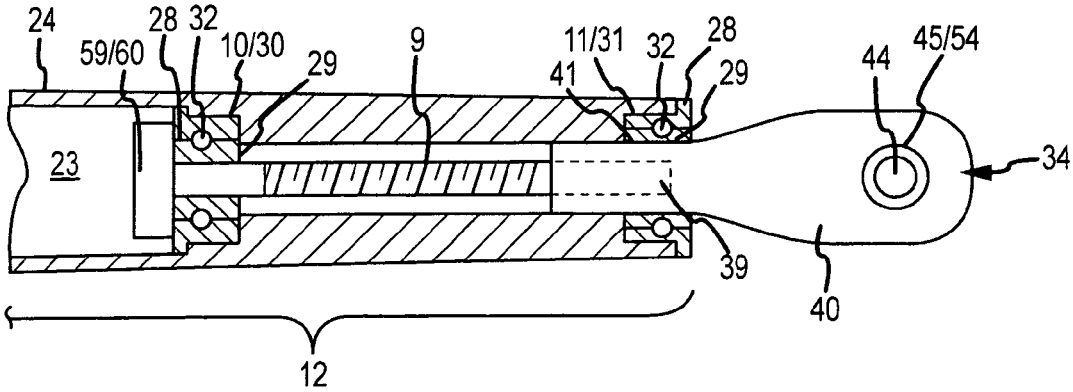
FIG. 9 is a cross section of the second handle end of a particular embodiment of the inventive jump rope.

Now referring primarily to FIG. 9, which provides a third non-limiting example of a first bearing element (10) and a second bearing element (11) each in the form of a rolling element bearing (30)(31) which provides a plurality of rolling elements (32) between a first circular bearing member (28) and a second circular bearing member (29). The relative motion of the first circular bearing member (28) and a second circular bearing member (29) causes the rolling elements (32) to roll. A specific example of a rolling element bearing (30)(31) which can be utilized in embodiments of the handle means (12) are available from Boca Bearings, Part Nos. MF85-ZZC (5×8×2.5) Metric or MF63-ZZC (3×6×2.5) Metric; however, these specific bearing elements (10)(11) are not intended to be limiting but rather are intended to provide the person of ordinary skill sufficient information to make and use the numerous and varied embodiments of the inventive handle (3) and jump rope (1).

The term "adapted to retain" for the purposes of this invention means a configuration which fixes the location of a first bearing element (10) and a second bearing element (11) in coaxial relation a distance apart to allow coaxially rotatably engagement of a shaft (9) with the first bearing element (10) and the second bearing element (11).

Figure 5:
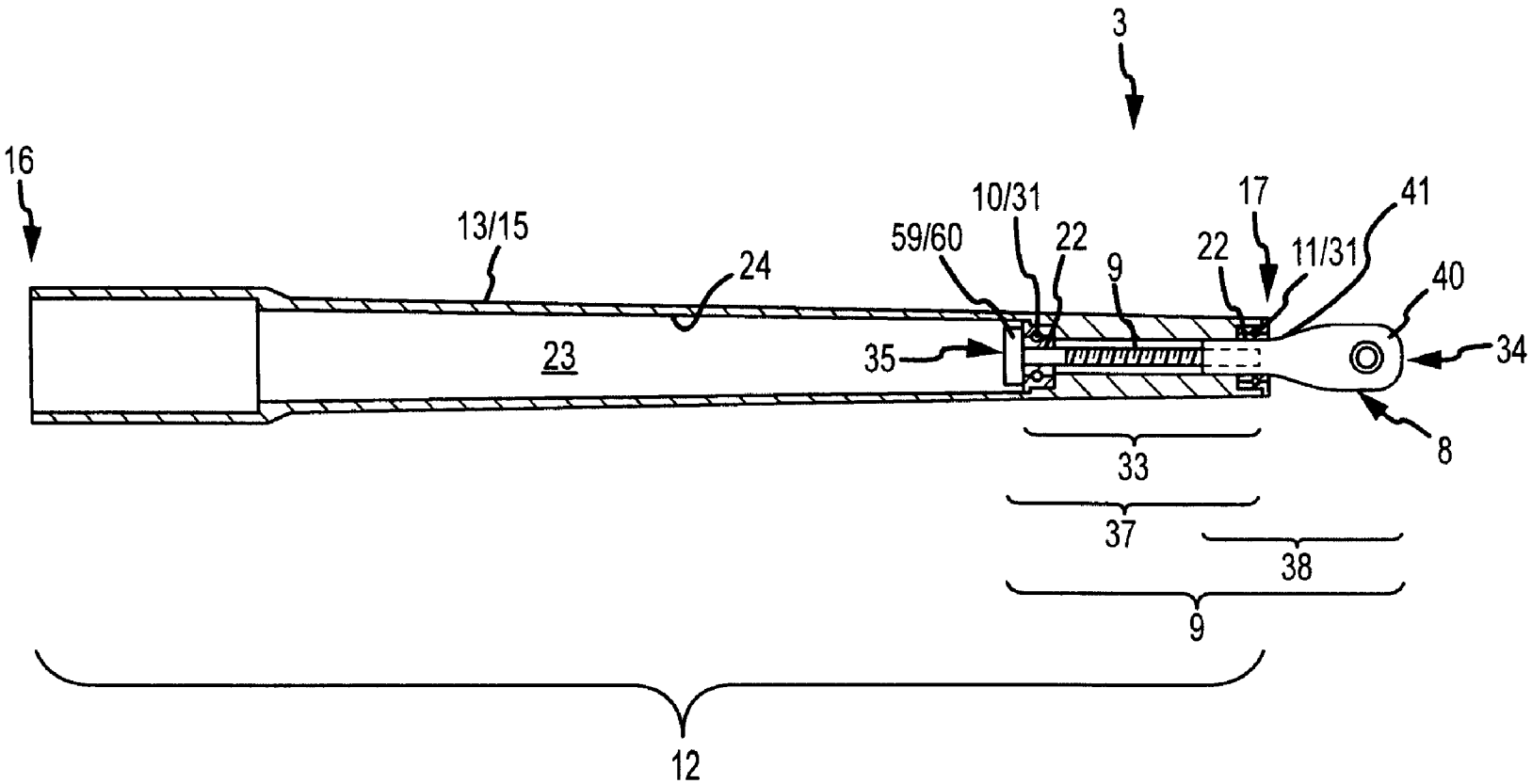
FIG. 5 is a cross section of the one of the pair of handles of a particular embodiment of the inventive jump rope.
Figure 6:
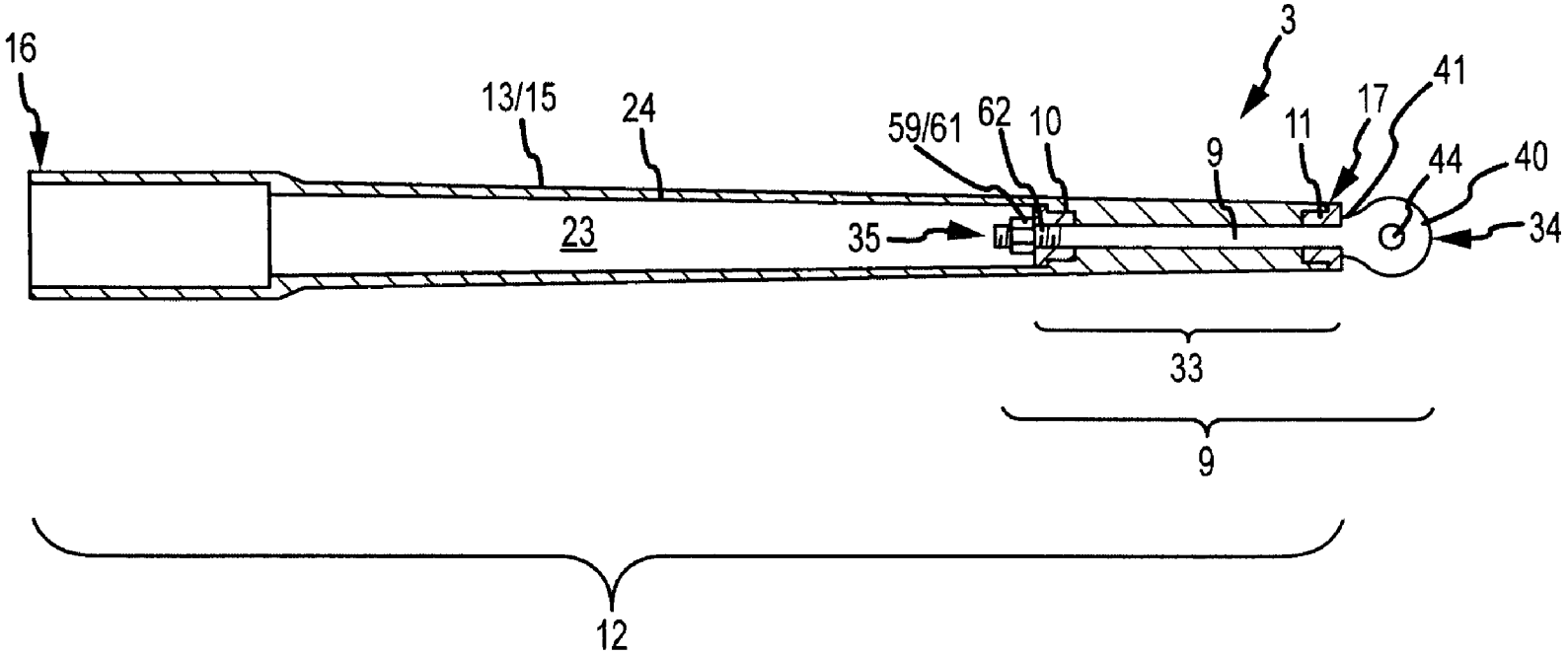
FIG. 6 is a cross section of the one of the pair of handles of a particular embodiment of the inventive jump rope.

Again referring primarily to FIGS. 5-9, the shaft (9) can provide an intermediate shaft portion (33) between a first shaft end (34) and a second shaft end (35) with the intermediate shaft portion (33) coaxially rotatably engaged to the first bearing element (10) and the second bearing element (11). As shown in FIG. 6, the intermediate shaft portion (33) can be provided as one cylindrical piece of substantially uniform diameter coaxially rotatably engaged to the first bearing element (10) and the second bearing element (11). However, as shown in FIGS. 5 and 7-9, certain embodiments of the intermediate shaft portion (33) can provide a two piece intermediate shaft portion (33) or a two piece shaft (9) wherein a first shaft piece (37) couples to a second shaft piece (38), each of the first shaft piece (37) and the second shaft piece (38) correspondingly coaxially rotatably engage to the first bearing element (10) and the second bearing element (11). As one non-limiting example, a socket head screw available from Fastenal Company (Part No. ms 25100025a200 (3×25) Metric) can be utilized as the first shaft piece (37) which as to certain embodiments can be rotatingly inserted into a closed end conduit provided by a Link, Part No. 12290, or provided by a Ball Link available from Du-bro Products, Inc. (Part Nos. 12290-c or 14840-c). The first shaft piece (37) and the second shaft piece (38) can have different diameters and the first bearing element (10) and the second bearing element (11) can be correspondingly configured. While these particular examples are provided of a first shaft piece (37) and a second shaft piece (38) the inventive handle (3) or inventive jump rope (1) is not so limited and the examples are intended to provide examples sufficient for a person of ordinary skill to make and use the shaft (9) whether in one piece (of substantially uniform diameter or of different diameters along the intermediate shaft portion (33)) or in two pieces (of substantially uniform diameter or of different diameters along the intermediate shaft portion (33)).

Now referring primarily to FIGS. 5 and 6, the first shaft end (34) can be adapted to couple to a first of the pair of opposed cable ends (8). The term "adapted to couple" for the purposes of the invention means a configuration of the first shaft end (34) which allows a first of the pair of the opposed cable ends (8) of the cable element (4) to attach to the first shaft end (34)

in a manner which upon travel of the cable element (4) through a turn (5) or part thereof generates a corresponding amount of rotation of the shaft (9) within the bearing elements (10)(11). This broad definition encompasses a numerous and wide variety of configurations of the first shaft end (34) including, but not limited first shaft end (34) configurations which provide a first shaft end aperture (44) through which one of the pair of opposed cable ends (8) can pass through and without limitation includes the configurations specifically described by the following examples and shown in FIGS. 3, 5-11.

Figure 10:
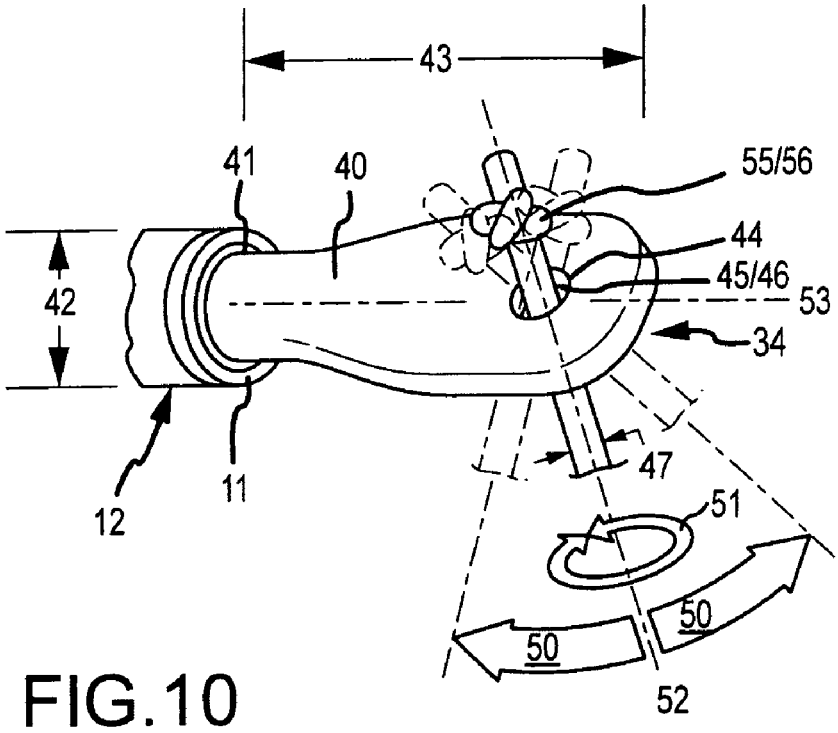
FIG. 10 is perspective view of the first shaft end of a particular embodiment of the inventive jump rope.
Figure 11:
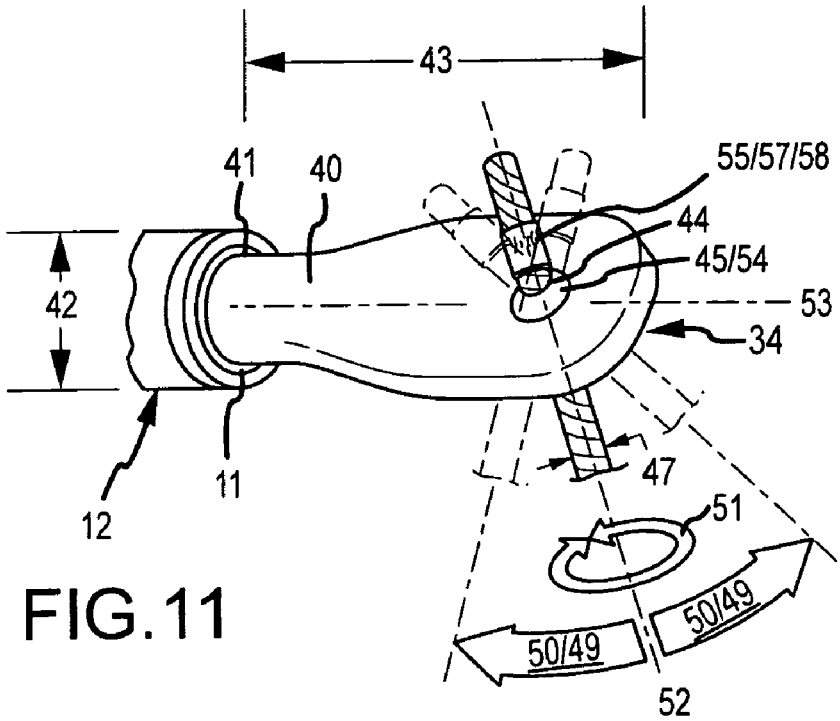
FIG. 11 is perspective view of the first shaft end of a particular embodiment of the inventive jump rope.

Now referring primarily to FIGS. 6 and 10-11, which show particular embodiments of a first shaft end (34) (or in those embodiments of a two piece shaft also referred to as a first shaft piece end) adapted to couple a first of the pair of opposed cable ends (8) each of which comprises a blade element (40) providing a pair of generally circular (see as an example FIG. 6) or rectangular (see as an example FIGS. 10-11) planar surfaces disposed in substantially opposed parallel relation. The blade element (40) provides a blade width (42) (or diameter) which prevents or limits axial travel through the annulus (41) of the second bearing element (11). The blade element (40) can further provide a blade height (43) sufficient to locate a blade aperture (44) at a location in relation to the handle (3) which allows the cable element (4) to turn (5) while avoiding or limiting contact with the first of the opposed pair of handles (3) or the handle (12) while turning (5). The blade aperture (44) while shown as a circular aperture in the Figures is not so limited and any aperture configuration which allows one of the pair of opposed cable ends to pass through can be suitable for use with the inventive handle (3) or inventive jump rope (1). Certain embodiments of the blade element (40) can provide a configuration which locates the blade aperture (44) at about three eighths inch to three quarters inch from the end of the handle means (12). Other embodiments of the blade element (40) can locate the blade aperture (44) at a distance of about one-half inch from the end of the handle (12) when the handle (12) has a configuration the same or similar to that shown in FIGS. 3 and 5.

The location of the blade aperture (44) (or as to other configurations of the first shaft end (34) also referred to as the first shaft end aperture element) can have a substantial effect on the rate at which the cable element (4) can turn (5). For example, if the blade aperture (44) has a location too close to the handle (12), the cable element (4) will contact the handle means (12) which can reduce rate and which the cable element can turn (5). Additionally, location of the blade aperture (44) at too great a distance from the handle means (12) can reduce the rate at which the cable element (4) turns (5). The rate at which the cable element (4) turn (5) can be limited because forces generated by the cable element (4) during a turn (5) act on a lever arm of increasing length as the blade aperture (44) has a location correspondingly distant from the handle means (12). When the blade aperture (44) has a location which provides a lever arm of too great a length the forces generated by the cable element (4) during a turn (5) can direct sufficient force to the handle means (12) to prevent the jumper (2) from increasing the rate of turn (5) of the cable element (4). Accordingly, as to embodiments of inventive jump rope (1) the first shaft end aperture element or blade aperture (44) can have a location which allows the greatest rate of turn (5) under a particular set of turn conditions.

Again referring primarily to FIGS. 10-11, the first shaft end (34) can further provide a cable pivot element (45). The cable pivot element (45) allows each of the pair of opposed cable ends (8) to be pivotally coupled to a corresponding first shaft end (34) or pivot in relation to the corresponding one of the pair of handles (3). The term "pivot" for the purposes of the invention includes any direction of travel by one of the pair of handles (3) within a swivel range (51) and a pivot range (50) defined by the configuration of cable pivot element (45) included in a particular embodiment of any one of the pair or handles (3), and typically, the swivel range (50) of embodiments of the cable pivot element (45) can be understood to allow the cable element (4) to rotate 360 degrees about the cable element axis (52) or can be understood to allow the corresponding one of the pair of handles (3) to rotate 360 degrees about the cable element axis (52); however, the invention is not so limited and certain embodiments of the inventive pair of handles (3) can provide a cable pivot element (45) which has a lesser swivel range (51) (for example 180 degrees, 120 degrees, 90 degrees or the like), and typically, the cable pivot element (45) can provide a pivot range (50) of about plus or about minus forty degrees from the neutral condition in which the cable element axis (52) is disposed in perpendicular relation to the shaft longitudinal axis (53); however, the invention is not so limited and certain embodiments of the inventive pair of handles (3) can provide a cable pivot element (45) which has a lesser pivot range (50) (for example 30 degrees, 20 degrees, 10 degrees, or the like from the neutral condition).

Now referring primarily to FIG. 10, a non-limiting example of a cable pivot element (45) can be a cable pivot aperture (46). A cable pivot aperture (46) can be differentiated from other embodiments of the first shaft end aperture element or blade element (44) by further establishing a spatial relationship between a cable element diameter (47) of the cable element (4) and a first shaft end aperture element diameter (48) which functions to allow each of the opposed cable ends (8) passed through the corresponding one first shaft end aperture element (44) to pivot (49) in relation to the first shaft end aperture element (44) without generating substantial flexure or substantially altering the configuration of the cable element (4). The allows the each of the pair of handles (3) to travel about the cable pivot element (45) within a the pivot range (50) and a swivel range (51) defined by the function of the cable pivot element (45) without altering, or reducing the amount of alternation, or maintaining the configuration of, the cable element (4) during a turn (5) (or during a plurality of turns).

Now referring primarily to FIG. 11, a non-limiting example of a cable pivot element (45) can provide a ball (54) pivotally coupled to the first shaft end (34) which further provides the first shaft aperture element (44) through which a corresponding one of the opposed cable ends (8) can pass for attachment to the corresponding one of the pair of handles (3). As one non-limiting example, the ball (54) pivotally coupled to the first shaft end (34) can be provided by utilization of a Ball Link available from Du-bro Products, Inc. (Part Nos. 12290-c or 14840-c). The ball (54) pivotally coupled to the first shaft end (34) allows each of the pair of opposed cable ends (8) to pivot as above described in relation to the corresponding one of the pair of handles (3). Because the ball (54) allows the corresponding one of the attached opposed cable ends (8) to pivot, the first shaft end aperture element (44) does not need to provide the inventive cable pivot aperture (46) as above described but can provide a first shaft end aperture element (44) sufficiently large to allow the corresponding one of the opposed cable ends (8) to pass through the first shaft end aperture element (44) for securement.

Again referring to FIGS. 10 and 11, each of the opposed cable ends (8) can be attached or secured to the first shaft end (35) by providing a cable securement element (55). The cable securement element (55) can be provided in a numerous and wide variety of configurations including for example generating an enlarged portion of the cable element (4) proximate to the each one of the pair of opposed cable ends (8). As shown by FIG. 10, the enlarged portion of the cable element can include a knot (56) in the cable element (4) sufficiently large not to pass through the first shaft end aperture element (44). As to other embodiments of the inventive jump rope (1), the cable securement element (55) can be provided as a mechanical cable fastener (57) which can be attached to each of the pair of opposed cable ends (8) sufficient large not to pass through the first shaft end aperture element. As non-limiting examples of mechanical cable fasteners (57) suitable for use with the inventive jump rope (10), slotted springs available from Fastenal Company (Part No. 64073), or suitably dimensions crimpable connectors (58) as shown in FIG. 11 can be utilized.

Now referring to FIGS. 5-9, the second shaft end second shaft end (35) can further provide a configuration adapted to couple to a second shaft end mechanical fastener (59) which axially limits travel of the shaft (9) coaxially rotatably engaged to the first bearing element (10) and the second bearing element (11). Now referring primarily to FIG. 5, as to certain embodiments of the invention, the second shaft end mechanical fastener (59) can be the head (60) of a socket head screw available from Fastenal Company (Part No. ms 25100025a200 (3×25) Metric). The elongate body of the socket head screw or similar mechanical fastener can as to certain embodiments provide the first shaft piece (37) as above described. Now referring primarily to FIG. 6, as to certain embodiments of the invention the second shaft end mechanical fastener (59) can provide a spirally threaded fastener body (61) rotatingly received by a corresponding spiral thread (62) of the second shaft end (35). While these two examples of a second shaft end mechanical fastener (59) are provided, the invention is not so limited and the second shaft end mechanical fastener (59) can be of any of a wide and numerous configurations which can be secured to the second shaft end (35) provides a fastener body sufficiently large to engages an external surface of said first bearing element to axially limit travel of said shaft coaxially rotatably engaged to said first bearing element and said second bearing element.

The various embodiments of the inventive jump (1) and each of the pair of handles (3) can be configured to be responsive to or attach a numerous and wide variety of cable element (4) including the non-limiting examples of a plastic cord, a nylon cord, a vinyl cord, a twisted steel wire, a braided steel wire, a galvanized steel wire, a stainless steel wire, and a coated wire of braided steel, galvanized steel, stainless steel, or the like. Additionally, while the specific examples provided herein refer to a cable element (4) attached at each of the opposed cable ends (8) to provide an inventive jump rope (1), the invention is not so limited and the inventive pair of handles (3) or each of the pair of handles (3) can be connected or attached to the cable element (4) of other kinds of apparatus such as jump rope training devices which provide an object tethered by the cable element to each of the pair of handles (3). As non-limiting example, one particular training device includes one of the pair of handles (3) a cable element having a first of the opposed cable ends (8) attached to the handle and a spherical means attached to the second of the opposed cable ends (8).

As can be easily understood from the foregoing, the basic concepts of the present invention may be embodied in a variety of ways. The invention involves numerous and varied embodiments of a jump rope system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "jump rope" should be understood to encompass disclosure of the act of "jumping rope"—whether explicitly discussed or not—and, conversely, were there effectively disclosure of the act of "jumping rope", such a disclosure should be understood to encompass disclosure of a "jump rope" and even a "means for jumping rope." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the jump ropes herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A jump rope, comprising:

a) a pair of handles each comprising:

i) a shaft rotatably journaled in at least one bearing element;

ii) a handle adapted to retain said shaft rotatably journaled in said at least one bearing element;

iii) a blade element coupled to said shaft, said blade element extending axially from said shaft a distance outward from said handle;

iv) a ball element pivotally coupled within an aperture of said blade element a distance from said handle; and b) a cable element having one of a pair opposed ends coupled to said ball element.

2. A jump rope as described in claim 1, wherein said shaft comprises a two piece shaft wherein a first shaft piece couples to a second shaft piece, rotatably journaled in at least one bearing element.

3. A jump rope as described in claim 2, wherein said first shaft piece provides a closed end conduit, and wherein said second shaft piece provides an elongate body received within said closed end conduit to couple said first shaft piece to said second shaft piece.

4. A jump rope as described in claim 3, wherein said first shaft piece, said blade element and said ball element pivotally coupled to said blade element comprise a ball link which provides said closed end conduit.

5. A jump rope as described in claim 4, wherein said second shaft piece comprises an elongate body having a fastener head which engages an external surface of said at least one bearing element to axially limit travel of said shaft coaxially rotatably journaled in said at least one bearing element.

6. A jump rope as described in claim 5, wherein said blade element has a configuration further adapted to axially limit travel of said shaft coaxially rotatably journaled in said at least one bearing element.

7. A jump rope as described in claim 6, wherein said at least one bearing element comprises a first rotatable element bearing.

8. A jump rope as described in claim 7, wherein said first rotatable element bearing comprises a first rolling element bearing.

9. A jump rope as described in claim 7, wherein said at least one bearing element further comprises a second rotatable element bearing.

10. A jump rope as described in claim 9, wherein said second rotatable element bearing comprises a second rolling element bearing.

* * * * *